US009476195B2

(12) United States Patent
Scherer

(10) Patent No.: US 9,476,195 B2
(45) Date of Patent: Oct. 25, 2016

(54) ANCHORING SYSTEM FOR A BEARING GROUND IN THE BUILDING INDUSTRY AS WELL AS PROCEDURE FOR APPLYING THE SAME

(71) Applicant: S&P Clever Reinforcement Company AG, Seewen (CH)

(72) Inventor: Josef Scherer, Brunnen (CH)

(73) Assignee: S&P Clever Reinforcement Company AG, Seewen (CH)

( * ) Notice: Subject to any disclaimer, the term of this patent is extended or adjusted under 35 U.S.C. 154(b) by 0 days.

(21) Appl. No.: 14/421,398

(22) PCT Filed: Aug. 7, 2013

(86) PCT No.: PCT/CH2013/000137

§ 371 (c)(1),
(2) Date: Feb. 12, 2015

(87) PCT Pub. No.: WO2014/026299

PCT Pub. Date: Feb. 20, 2014

(65) Prior Publication Data

US 2015/0218797 A1 Aug. 6, 2015

(30) Foreign Application Priority Data

Aug. 14, 2012 (CH) ..... 1358/12

(51) Int. Cl.
*E04C 5/00* (2006.01)
*E04B 1/41* (2006.01)
(Continued)

(52) U.S. Cl.
CPC ..... *E04B 1/4157* (2013.01); *C22C 38/02* (2013.01); *C22C 38/04* (2013.01); *C22C 38/40* (2013.01); *C21D 2201/01* (2013.01)

(58) Field of Classification Search
CPC ..... E04B 2/84; E04B 2001/3583; E04B 1/4157; C22C 38/04; C22C 38/02; C22C 38/40; C21D 2201/01
USPC ..... 52/704, 835, 309.14, 309.15
See application file for complete search history.

(56) References Cited

U.S. PATENT DOCUMENTS 4,295,761 A * 10/1981 Hansen ..... 405/259.6
4,452,028 A * 6/1984 Norton et al. ..... 52/742.14
(Continued)

FOREIGN PATENT DOCUMENTS

WO WO 9612588 A1 * 5/1996 ..... B23P 6/04
WO WO 0186096 A1 * 11/2001
WO WO 2014166003 A3 * 4/2015

OTHER PUBLICATIONS

KRL; "What's the Difference Between NITI, NITICU and NITIFE?"; Source: http://www.kellosgsresearchlabs.com/index.php?route=information/information&information_id=17; Retreived Jun. 20, 2016.

*Primary Examiner* — Basil Katcheves
(74) *Attorney, Agent, or Firm* — Polsinelli PC

(57) ABSTRACT

Anchoring system is appropriate for solid rock and concrete (2) and any firm bearing system. The anchor rod (4) of for example a threaded bar out of a shape memory alloy (SMA) is held in the armature bore (3) with a filling compound (5) as anchoring means. For filling the achoring bore (3) between anchor rod (4) and wall of the armature bore (3) a heat resistant filling compound (5) of a polymer connection on a two-component-basis or such on a cementous basis is used. Then the anchor rod (4) is heated by heat input over its butt that is emerging the filling compound on its austenit phase, which pre tensions the anchor rod (4). Finally, after the cooling of the filling compound (5) the anchor rod (4) is cooling of to ambient temperature. A counter bearing board (10) lays on the outer wall (1) around the port of the armature bore (3) and is tensed up with the anchor rod (4).

7 Claims, 1 Drawing Sheet

Figure 1:
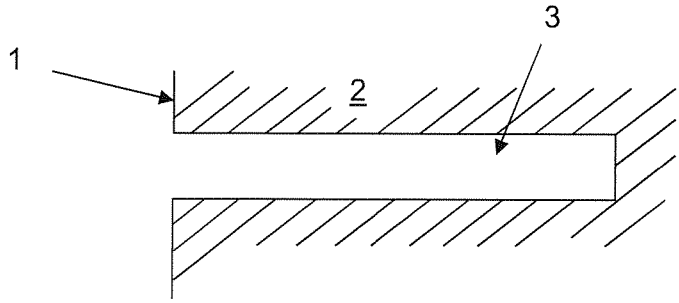

(51) Int. Cl.

| | |
|---|---|
| ***C22C 38/02*** | (2006.01) |
| ***C22C 38/04*** | (2006.01) |
| ***C22C 38/40*** | (2006.01) |

(56) References Cited

U.S. PATENT DOCUMENTS

| | | | | |
|---|---|---|---|---|
| 4,662,795 | A * | 5/1987 | Clark et al. | 405/259.6 |
| 4,699,547 | A * | 10/1987 | Seegmiller | 405/288 |
| 5,040,283 | A * | 8/1991 | Pelgrom | 29/447 |
| 5,093,065 | A * | 3/1992 | Creedon | 264/228 |
| 5,289,626 | A * | 3/1994 | Mochida et al. | 29/452 |
| 6,233,826 | B1 * | 5/2001 | Wycech | 29/897.1 |
| 6,775,894 | B2 * | 8/2004 | Hardin | 29/402.09 |
| 7,033,116 | B1 * | 4/2006 | Ward et al. | 405/229 |
| 2002/0041796 | A1 * | 4/2002 | Greenberg | 405/284 |

* cited by examiner

ANCHORING SYSTEM FOR A BEARING GROUND IN THE BUILDING INDUSTRY AS WELL AS PROCEDURE FOR APPLYING THE SAME

CROSS REFERENCE TO RELATED APPLICATIONS

This is the national stage of International Application No. PCT/CH2013/000137, filed Aug. 7, 2013, which application claims priority to Swiss Patent Application No. CH20120001358, filed Aug. 14, 2012. All of the above-identified applications are incorporated herein by reference in their entireties.

This invention relates to an anchoring system to be applied on any bearing ground independent on the kind of bearing ground. The anchoring system is also suitable for placing of rock anchors or concrete anchors, as such are indispensable in the building industry for many purposes, and furthermore the invention relates to a procedure for applying this system.

When a construction work is made or if an already finished construction work is restored, anchors are often used for stabilization and protection of an existing bearing ground. The substrate can be of any shape, e.g. a natural bearing ground like for example rock or ice or an artificially made bearing ground made of concrete, reinforced concrete, wood or another material.

As yet, especially outer mechanical tensioning elements are used for the restoration of building structures with reduced load-absorption capacities, or such ones which are in jeopardy of a substantial deformation as a consequence of suddenly increasing loads, and these elements are being pretensioned mechanically or hydraulically. In combination with the use of such tensioning elements, the anchors play a big role. When such anchor rods absorb high loads in a whole within a building structure, the force transmission of the building structure on the anchor rod is of crucial meaning. Usual systems adapt steel bars with different surface structures as for example threads, ripped or other structures as anchor rods and those are force-fitting glued with a filling compound within the anchor hole with the bearing ground. The filling compound consists of preferably polymer compounds of two-component-basis or such of cementitious basis. The filling compound is filled in or inlayed as two-component-fuse into the drill hole. When the filling compound is hardened, the anchor can take up load.

With many building structures having large overhang concrete floors, the same will also be supported peripherally by columns, e.g. in case of subterranean garages. The contact points of the columns are particularly charged with loads and in case of an overload, a punching effect threatens. In order to avoid this effect, punching reinforcements are incorporated into the concrete layers. In some building structures those punching reinforcements are executed sufficiently strong or they even lack at all and these structures should accordingly be restored. Hereunto, anchors are also subsequently inserted into the area of the column reinforcements, for what cylindrical bores are inserted into the concrete. The inserted anchors which are formed like steel bars are subsequently glued within the hole by means of an injection mortar or glue, for example using an epoxy resin and they are pretensioned by a threaded nut and an abutment board and pretensioned from the covering side.

However, the gluing in of steel bars is susceptible for failures. Bigger or smaller air inclusions within the anchoring bulk cannot be excluded with certainty. A supplementary disadvantage of this anchoring lays in that the anchor-reinforced area of the layer defies largely a thermal deformation, which imports the risk that in case of high heat load, tension cracks and respectively coverage fractures do relocate from the column areas to the self supported coverages. Due to the anchoring-gluing along the anchor rod, a tensioning of the anchor rod, for example by pulling of a counter bearing nut at an end thread of the anchor rod is no more possible after hardening of the gluing substance.

Alternative anchoring systems work with end-anchorage. WO 2009/027543 for example shows such an end-anchorage system. At the end of the produced blind hole, a cavity is broached, in which after setting the anchor, an epoxy resin is charged under pressure as anchoring means. Thereby, a remaining clear space between the wall of the blind hole and the anchor rod secures the escaping of air of the filling room of the expansion cavity which is designed with a structured surface, for example with circumferential notches for a particularly good grip. Furthermore, anchors with mechanical barbs in their end area are known. All end-anchorages show the disadvantage that the length of the anchor rod is not used for the transfer of force onto the concrete, but the anchor only transfers forces in its end area.

The objection of the present invention is to provide an anchoring system and a procedure for its application where the transfer of force of the steel anchor into the bearing ground is ensured over the whole anchorage length. The procedure for the application shall enable a linear pretension of the anchor over its whole length after hardening of the filling compound.

This objection is solved by an anchoring system for firm bearing grounds which is characterized in that the anchor rod is made of a shape memory alloy (SMA) of polymorph and polycrystalline structure which is transformable from its martensite condition to its austensite condition by increasing its temperature and in which said alloy runs over into a pretensioned condition when it is firmly anchored (mortar-fixed).

The objection is further solved by the procedure for applying this anchoring system which is characterized in that a) an anchor drilling is established within the bearing ground that is to be reinforced,
b) an anchor rod made of a shape memory alloy (SMA) in form of a rod having rough surface structure is set into the anchor drilling,
c) the space between anchor rod and wall of the anchor drilling is filled completely with a heat resistant filling compound,
d) the anchor rod made of shape memory alloy (SMA) is being heated after hardening of the filling compound from its butt emerging from the filling compound by heat supply to the temperature of the austenite phase so that a linear pretension is produced inside the filling compound.

With the help of the drawings, the anchoring system is presented and in the following description it is delineated and its function and effect are explained.

Furthermore, the procedure for applying this anchoring system is described and explained.

Figure 2:
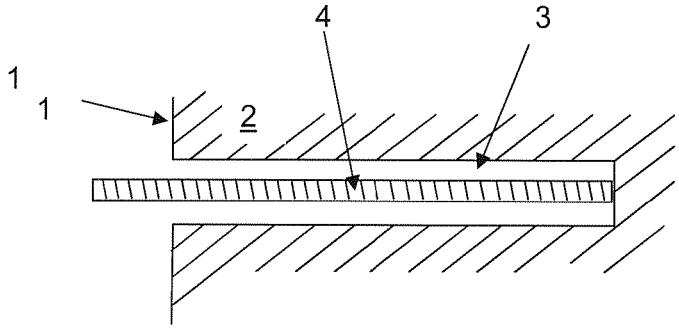
Figure 3:
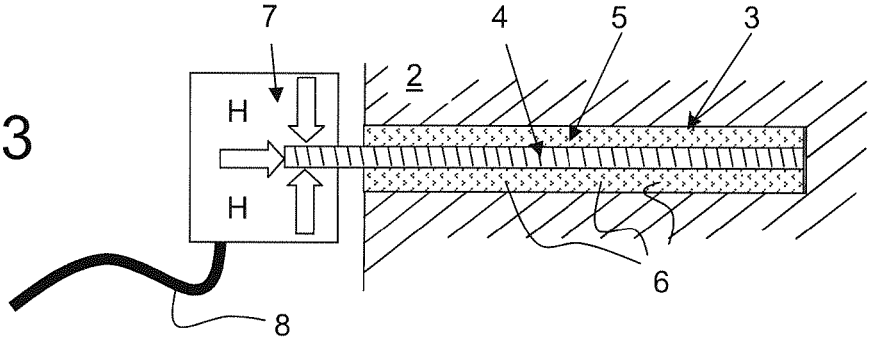
Figure 4:
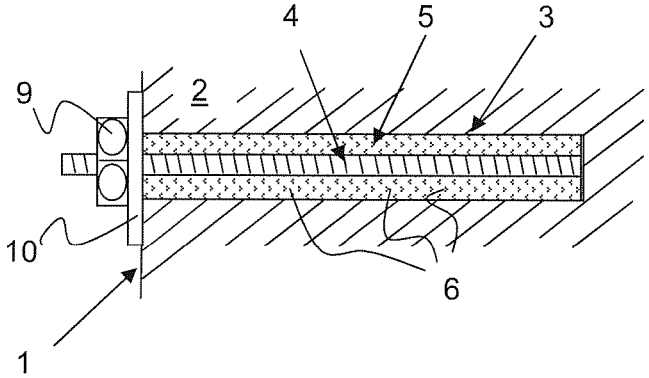

It shows:

FIG. 1: A prepared anchor hole;

FIG. 2: An anchor hole with inserted anchor rod for filling the anchor hole;

FIG. 3: An anchor hole with inserted anchor rod and filling of the free space with an anchoring means, in the state when heat is supplied to the threaded rod;

FIG. 4: The completed set and pretensioned anchor.

Firstly, the nature of shape memory alloys (SMA) must be understood. It is the matter about alloys that show a special structure that is changeable heat-depending but that will return to its initial state after heat supply. Like other metals and alloys, SMA's contain more than one crystalline structure they are polymorph and thus polycrystalline metals. The dominant crystalline structure of the SMA's depend on one hand of its temperature, on the other hand from the outwardly operating tension—be it tension or pressure. The phase on high temperature is called austenite, the one on low temperature martensite. What is special on that shape memory alloys is that they return to their initial structure and form after elevating the temperature into the high temperature phase, even if they were deformed before in the low temperature phase. This effect can be exploited for applying pretensioning forces into structures of a building.

If no heat is artificially inserted into or removed from the SMA (shape memory alloys), then its temperature is the environmental temperature. The SMA are stable within a typical temperature range, this means that their structure does not change within special boundaries of mechanical burdens. For purposes within the building industry in the outdoor section, their range of variations of the environmental temperature of −20° C. to +60° C. is assumed. Within this temperature range, an SMA being used shall not change its structure. The temperatures of transformation in which the structure of the SMA changes can vary significantly, depending on the composition of the SMA. The temperatures of transformation are also depending on the load. The higher the mechanical burden of the SMA is, the more its transformation temperatures changes. If the SMA shall remain stable within certain limits of burden, then the limits must be respected. If SMAs are used for structural exhaustion, then the fatigue quality of the SMA must be considered besides the corrosion resistance and relaxation effect, especially if the burdens do vary over a period of time. Thereby, it is distinguished between structural exhaustion and functional exhaustion. The structural exhaustion concerns the accumulation of microstructural defects as for example the formation and the diffusion of surface fractures until the material finally brakes. The functional exhaustion instead is a consequence of the gradual degradation or of the shape memory effect or of the camping capacity by arising microstructural changes within the SMA. The latter is connected to the modification of the tension and elongation curve under cyclical burden. The transformation temperatures do also change thereby.

For gathering of permanent burdens in the building sector, SMA on the basis of Iron Fe, Mangan Mn and Silicium Si are suitable, whereby the adding of up to 10% Chrome Cr and Nickel Ni, brings the SMA to a similar corrosion behavior as stainless steel. In literature it is found that by adding Carbon C, Cobalt Co, Copper Cu, Nitrogen N, Niobium Nb, Niobium—Carbide Nb C, Vanadium—Nitrogen and Zirconium—Carbide ZrC, the shape memory properties may improve in several ways. An SMA of Fe—Ni—Co—Ti which can take loads until 1000 MPa shows exceedingly good properties, it is highly resistant to corrosion and its upper temperature for coming into the austensite condition is approximately 100° C.

The present anchoring system uses the properties of SMA. The anchors in shape of round steels with rough surfaces for example with thread surface are inserted into the anchor drills and the anchor drills are filled with a heat resistant polymer mass through which the anchors are anchored therein. As a special characteristic, the anchor rods consist of a shape memory alloy (SMA) and the alloy having the property to return to its original condition through heat supply, which means into a contracted condition. If the anchor rods are heated to the temperature for the austensite condition, then they return to their original form and keep it, also under load. The achieved effect is that the anchor rods filled into the heat resistant filling compound create a pretensioning force after heating, as a consequence of the prevented back-forming of the shape memory alloy (SMA) due to its concrete-cast embedding, whereby the pretension extends evenly or rather linear over the whole length of the anchor. The hardened filling compound ensures that the anchor within the anchor drill is anchored with very high and durable adhesive powers.

For the insertion of such an anchor in practise, it is proceeded as follows: Initially, an anchor drill 3 in the concrete 2 or solid rock is made from the outer wall 1 of the structure of a building, as described in FIG. 1. Then, an anchor 4 in shape of a steel rod from a shape memory alloy (SMA) with rough surface is inserted into the anchor drill 3 so that this drill is running coaxially as shown in FIG. 2. A threaded rod is especially suitable because of its particular surface structure as anchor rod, whereby the surface of the anchor rod can also be in form of else wise formed burlings or ribs. Then, the space between anchor rod 4 and the wall of the anchor drill 3 is completely filled with the filling compound 5, favorably with a heat resistant polymer matrix. This condition is shown in FIG. 3. The anchor rod is anchored firmly into the hardened filling compound. In the next step, the anchor rod 4 is heated up to a temperature between 150° and 300° C. by heat supply from its outer stub which is emerging from the anchor drill. In the easiest case, this can happen through a gas burner by directing its flame towards the stub of the anchor rod 4. But it is more advantageous to place an electrical or gas-powered heater 7 outside around the anchor rod 4 which is emerging out of the building structure and heat H is brought inside in a controlled manner by the same. The arrows within the heater 7 indicate the heat flow of the device within anchor rod 4. The necessary temperature shall be between 150° C. to 300° C., depending on the used shape memory alloy (SMA) of anchor rod 4. The heater 7 having an electrical cable 8 can have a temperature sensor for this purpose which lays on the emerging anchor rod 4 and which measures the temperature. The temperature must ensure that the austenite condition of the anchor rod 4 is sure reached over its full length. It will take a time until heat H has reached the end of the anchor rod 4. The anchor rod also heats the touching filling compound, this is why this one must be heat resistant and tolerate at least the reached temperatures between 150° and 300° without damage and without changing is structure.

After cooling of the filling compound 5 to the outer temperature, the anchor rod 4 which is pretensioned within its anchoring remains permanently pretensioned thanks to its material properties, on a tension of 200 to 500 Mega-Pascal (1 MPa=$10^6$ N/$m^2$). Through a threaded nut 9 and an abutment plate 10, which is layed around the anchor drill 3 on the outer wall 1, can have an effect on it. Anchor rods 4 fastened in this manner are in any case tensioned evenly over their whole length.

The invention claimed is:

1. An end anchoring system for solid load bearing grounds, the end anchoring system comprising:

an anchor bore within a solid bearing ground of one of concrete, reinforced concrete, rock, wood or ice;

a heat resistant filling compound, the filling compound being a mortar containing a polymer composite of a two compound basis or of a cementitious basis, the filling compound tolerating at least temperatures between 180° C. and 300° C. without damage and without changing structure;

an anchor rod being a tieback within the anchor bore; and a threaded nut and an abutment plate being laid around the anchor bore on the outer wall of the anchor bore and fastened to the anchor rod by tension;

wherein the anchor rod comprises:

a shape memory alloy (SMA) of a polymorph and polycrystalline structure of at least iron (Fe), nickel (Ni), cobalt (Co) and titanium (Ti), and a structured surface with differently aligned ribs or threads, wherein the SMA is transformable from a martensitic condition to an austensitic condition by increasing its temperature to between 80° C. and 300° C., wherein the anchor rod is mortar-fixed by means of the anchor rod-jacketing heat resistant filling compound, and wherein the anchor rod is pretensioned within the anchor bore and capable of absorbing up to 1000 MPa of load.

2. The end anchoring system according to claim 1, the SMA further comprising manganese (Mn), silicon (Si) and chromium (Cr), wherein Cr and Ni are up to 10% of the SMA.

3. The end anchoring system according to claim 2, wherein the SMA further comprises one or more of carbon (C), copper (Cu), nitrogen (N), niobium (Nb), niobium carbide (NbC), vanadium nitrogen (VN) and zirconium carbide (ZrC).

4. A procedure for applying the end anchoring system according to claim 3, comprising:

a) producing the anchor bore within the solid bearing ground, b) placing the anchor rod into the anchor bore, c) filling the space between the anchor rod and the anchor bore with a heat resistant filling compound to create an around-mortar, d) hardening the filling compound, e) transforming the SMA of the anchor rod to its austensitic phase by heating the anchor rod to a temperature between 180° C. and 300° C. using a heat source, the heat source applying heat to a portion of the anchor rod which extends out of the filling compound, f) wherein after the initial tensioning of the anchor rod in the filling compound, a threaded nut and an abutment plate are laid around the anchor bore on the outer wall of the anchor bore and fastened to the anchor rod by tension.

5. The procedure according to claim 4, wherein a linear tension within the filling compound in the range of 50 to 1000 MPa is obtained.

6. The procedure according to claim 4, wherein a linear tension within the filling compound in the range of 200 to 1000 MPa is obtained.

7. A procedure for applying the end anchoring system according to claim 1, comprising:

a) producing the anchor bore within the solid bearing ground, b) placing the anchor rod into the anchor bore, c) filling the space between the anchor rod and the anchor bore with a heat resistant filling compound to create an around-mortar, d) hardening the filling compound, e) transforming the SMA of the anchor rod to its austensitic phase by heating the anchor rod to a temperature between 180° C. and 300° C. using a heat source, the heat source applying heat to a portion of the anchor rod which extends out of the filling compound, f) wherein after the initial tensioning of the anchor rod in the filling compound, a threaded nut and an abutment plate are laid around the anchor bore on the outer wall of the anchor bore and fastened to the anchor rod by tension.

* * * * *